United States Patent [19]

Hoffman

[11] Patent Number: 4,941,270

[45] Date of Patent: Jul. 17, 1990

[54] OZONE DRYER

[75] Inventor: G. E. Bud Hoffman, Brampton, Canada

[73] Assignee: 501 Geonate Holdings Inc., Brampton, Canada

[21] Appl. No.: 307,504

[22] Filed: Feb. 8, 1989

Related U.S. Application Data

[63] Continuation-in-part of Ser. No. 98,924, Sep. 21, 1987, abandoned.

[51] Int. Cl.[5] ..... F26B 11/04

[52] U.S. Cl. ..... 34/60; 34/72; 34/133; 422/29

[58] Field of Search ..... 34/32, 60, 72, 133; 422/24, 123, 124

[56] References Cited

U.S. PATENT DOCUMENTS

| | | | |
|---|---|---|---|
| 2,434,886 | 1/1948 | Pugh | 34/60 |
| 2,752,694 | 7/1956 | McCormick | 34/60 |
| 2,780,008 | 2/1957 | Stickel . | |
| 2,798,306 | 7/1957 | Reiter | 34/133 |
| 3,226,842 | 1/1966 | Morey | 34/72 |
| 3,437,424 | 4/1969 | Erbor | 422/124 |
| 3,438,136 | 4/1969 | Raymond | 34/72 |
| 3,877,152 | 4/1975 | Gorman . | |
| 4,086,707 | 5/1978 | Bochan . | |
| 4,182,050 | 1/1980 | Righi . | |

FOREIGN PATENT DOCUMENTS

| | | |
|---|---|---|
| 1056273 | 2/1954 | France . |
| 54-147561 | 11/1979 | Japan . |
| 84/03311 | 8/1984 | PCT Int'l Appl. . |
| 592707 | 9/1947 | United Kingdom . |

*Primary Examiner*—Harold Joyce

[57] ABSTRACT

A domestic clothes dryer having ozone disinfectant features. The clothes dryer includes a rearwardly exposed air inlet providing a flow path for air to be drawn into and circulated interiorly of the dryer, and the air intake in turn includes an access region which is fitted with an ozone producing corona grid member positioned in the flow path so that the air is ozone charged prior to being circulated within the dryer.

3 Claims, 3 Drawing Sheets

OZONE DRYER

This is a continuation-in-part application of U.S. patent application Ser. No. 098,924, filed Sept. 21, 1987 and now abandoned.

FIELD OF THE INVENTION

The present invention relates to a domestic clothes dryer including an ozone producing unit for ozone treatment of air entering the dryer and to be circulated to disinfect clothing within the dryer.

BACKGROUND OF THE INVENTION

The most common method of cleaning clothing, bed sheets or similar articles is to water wash them using detergents, bleaches, etcetera in a washing machine. After the washing cycle has been completed, the articles are then generally placed in a heated dryer. However, this method of washing and drying does not ensure elimination of bacterial contamination of the articles. The washing cycle is effective against visible stains and the like but does not necessarily kill bacteria and germ spores.

It is known that ozone is a bacteria fighting agent. One particular means for producing ozone is an electrical corona grid. It is also known that special dryers can be built with electrical corona grids such as the dryer shown in U.S. Pat. No. 3,877,152, issued Apr. 15, 1975 to Gorman. However, a structure such as the Gorman dryer is really not something that could be practically used in a standard residental set up because of both the complexity and the cost involved with the Gorman dryer. In fact, the Gorman dryer is likely too complex to even be used for industrial purposes or in a laundry mat or the like.

There is a need for a dryer which is simple and inexpensive enough to be used domestically but which has the capability of being effective against bacterial contamination of articles to be placed in the dryer.

SUMMARY OF THE PRESENT INVENTION

The present invention provides a domestic clothes dryer which has a rearwardly exposed air inlet providing a flow path for air to be circulated interiorly of the dryer. The air intake itself has an access region and that access region is fitted with an ozone producing corona grid member positioned in the air flow path so that the air is ozone charged prior to being circulated within the dryer.

The above arrangement requires only minimum alteration with little added cost to a conventional dryer. Furthermore, the dryer itself when in its use position does not look anything different from a standard dryer making it extremely appealing to the residential user of the dryer.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
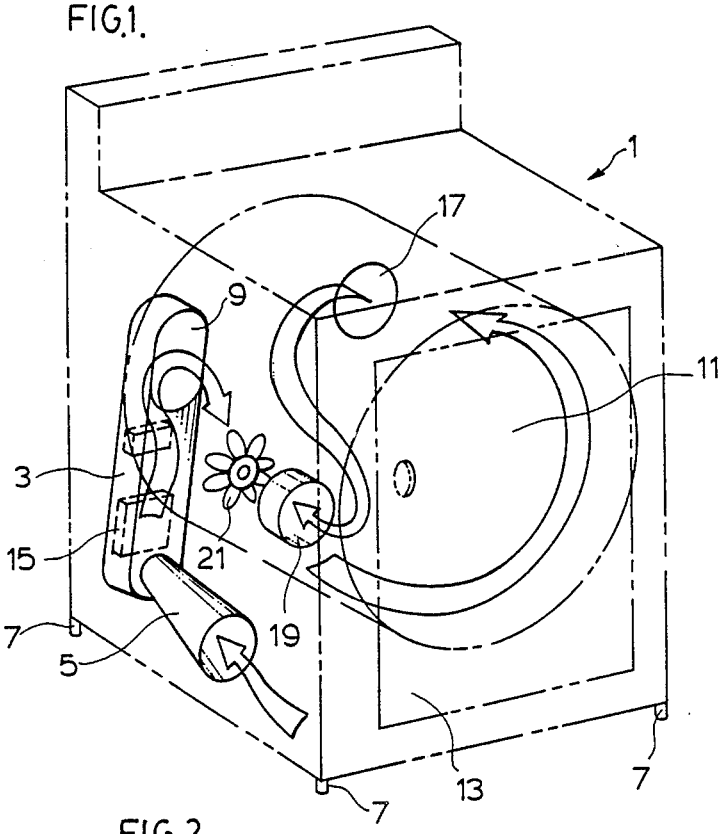
FIG. 1 is a perspective view showing in phantom a dryer body and the flow path of air through that dryer body including an ozone producing unit according to a preferred embodiment of the present invention.

FIG. 1 shows what, from the outside, would appear to be a conventional domestic or home clothes dryer generally indicated at 1. This dryer includes a rear air intake 3 which actually sits to the outside of the dryer body. Air intake 3 has a forward opening air inlet 5 which because the dryer is supported on small legs 7 is able to draw air from beneath the front of the dryer. This is the preferred set up simply because it is not generally possible to clean on a regular basis behind the dryer making it undesirable to draw the air from the dirty area behind the dryer.

Figure 2:
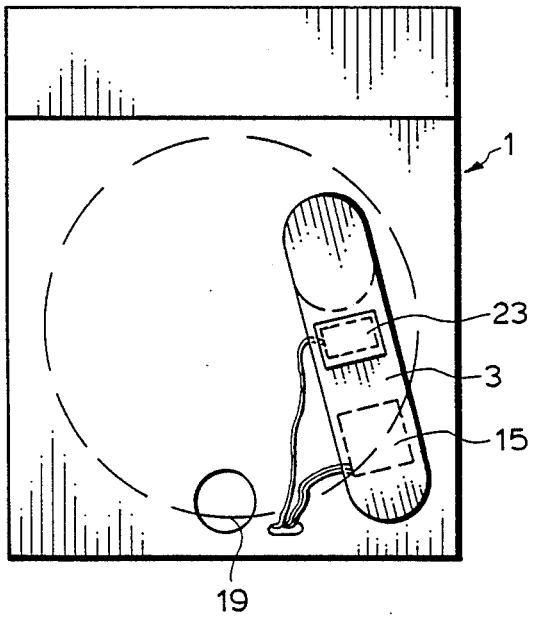
FIG. 2 is a rear plan view of the dryer of FIG. 1.

The dryer includes an internal drying or tumble chamber 11 which is fed air through the forward opening 9 at the top of intake 3 into the tumble chamber. Located to the back of the tumble chamber is an outlet or duct 17 which then feeds the dryer exhaust 19 once again exhausting to the back of the dryer seen in FIG. 2. Located internally of the dryer is a fan or blower 21 which creates the suction effect to draw in the air and then force it outwardly through the exhaust.

In accordance with conventional practice, duct 3 is provided with a heater 15. Therefore, the air entering the dryer must first pass through and around the heater resulting in heated air within the dryer.

Figure 3:
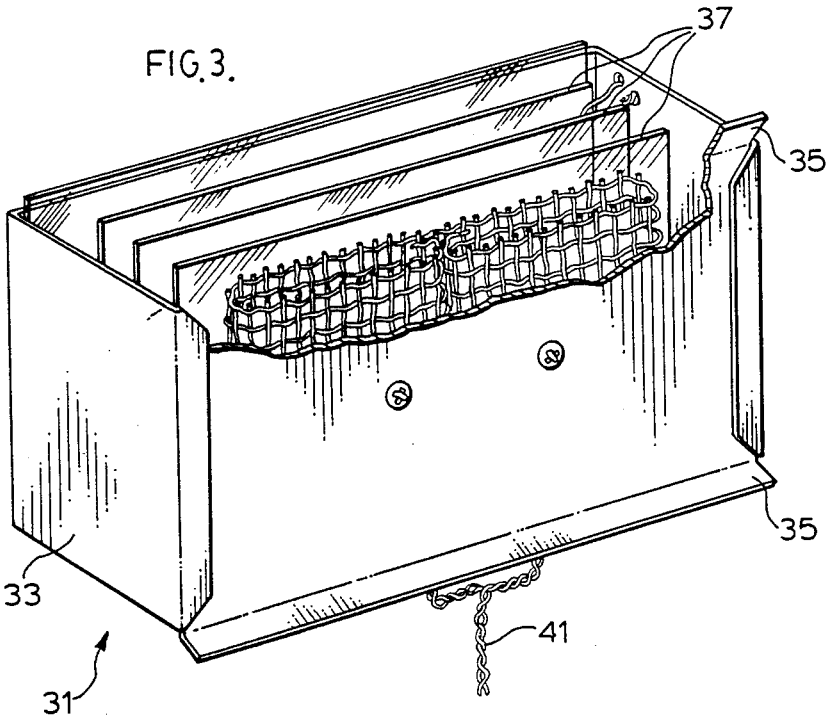
FIG. 3 is an enlarged perspective view of the ozone producing unit fitted into the dryer of FIG. 1.

All of the construction described above is conventional design and the essence of the present invention is to provide an ozone producing unit generally indicated at 31 in FIG. 3 which easily and accessibly fits into air intake 3 requiring only very minor modifications to the dryer and not changing the outward appearance of the dryer from a standard dryer making the dryer extremely appealing for the domestic user. Furthermore, the ozone producing unit does not affect the internal mechanics of the dryer in the tumbling chamber or elsewhere such as the door or the like.

Figure 5:
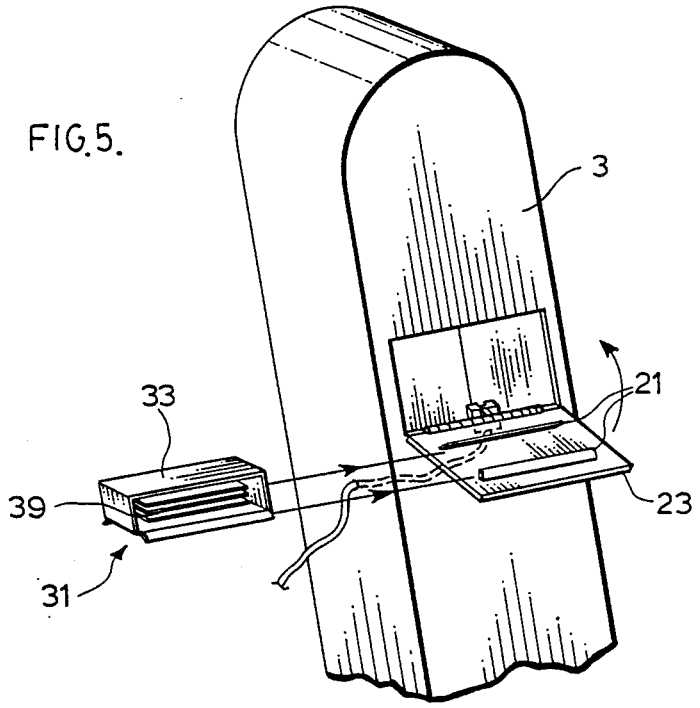
FIG. 5 is an enlarged perspective view of the air intake on the back of the dryer of FIG. 2.
Figure 6:
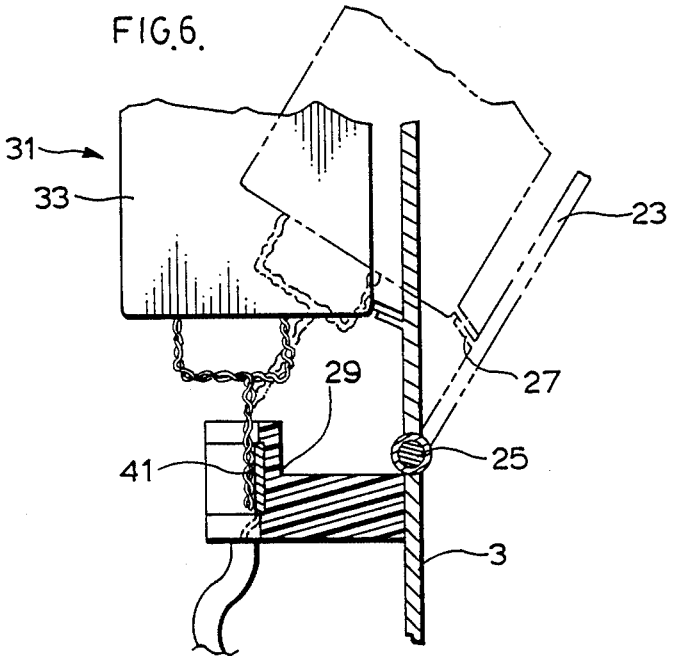
FIG. 6 is a sectional view through the air intake of FIG. 5 showing the ozone producing unit being fitted into the air vent.

FIG. 5 shows the actual air intake or duct 3 which, as noted above, is physically located to the outside of the back of the dryer. This air intake, unlike conventional air intakes is provided with an access region in the form of a small readily accessible door 23. Door 23, as best seen in FIG. 6 of the drawings, is secured by a hinge 25 to the air intake.

Figure 4:
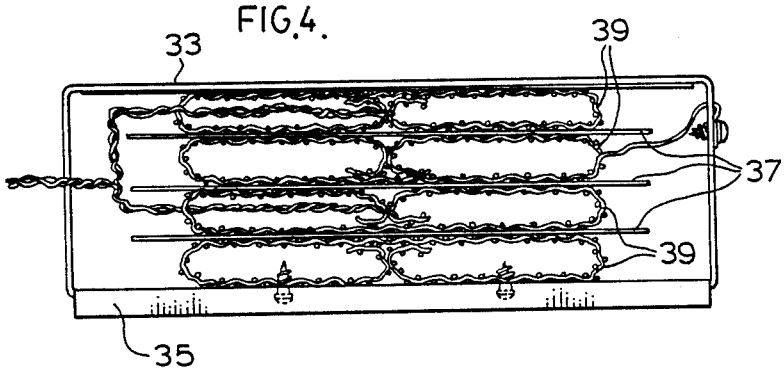
FIG. 4 is a top plan view of the ozone producing unit of FIG. 3.

Provided to the interior surface of door 23 are a pair of guide rails or tracks 27. These tracks are designed to receive the ozone producing unit 31, the details of which are best seen having reference to FIGS. 3 and 4 of the drawings.

In particular, ozone producing unit 31 is an electrical corona grid comprising an outer frame 33 with a series of fins or baffles 37 supporting a plurality of electrical grid members 39. All of these grid members feed off one another to effectively form one common large grid. This common large grid presents an electrical contact 41 which extends outwardly through the open bottom of frame 33. As will be seen in FIG. 3, the top of the frame is also opened to allow air flow through the ozone producing unit.

The frame 33 of the ozone producing unit is provided with a pair of runners 35. These runners are shaped, positioned and sized for a sliding fit directly in the guide tracks 27 of the air intake door 23. In order to fit the ozone producing unit in the air intake, door 23 is laid fully open as shown in FIG. 5 giving ample room for sliding the ozone producing unit into position on the door including clearance that is required where electrical contact 41 extends to the bottom of the ozone producing unit. Once the ozone producing unit has been properly positioned on the door, the door is then raised upwardly through the dotted line and to the solid position shown in FIG. 6 of the drawings. Provided interiorly of the air intake 3 is a contact closure 29 preset or positioned such that the electrical contact 41 drives up against contact closure 29 with, as can be seen in FIG. 6, a substantial overlap between electrical contact 41 and the closure 29.

A number of features ensure that there is full contact between electrical contact 41 and the closure 29. Firstly, and as noted above, there is a substantial overlap between the two rather than a single point contact. Secondly, electrical contact 41 is made of a hard wire-like material and is not easily bent or deformed to ensure good closure with member 29. Finally, the set up of all the interlocking components and the positioning of the door in the intake ensures that electrical contact 41 is driven up firmly against the preset or prepositioned closure 29.

As will be appreciated from the description above, because of the positioning of the ozone producing unit directly in the flow path for the air passing through the air intake, the air itself is charged with ozone as it enters the tumble chamber. The operation of the ozone unit is preferably set such that it automatically comes on or produces an electrical charge with the operation of the dryer. However, the ozone unit may also be set up with its own control or on a timer or the like provided separately on the dryer.

From the servicing or replacement standpoint, one only needs to get to the back of the dryer, open the door 23 and quickly and easily remove the ozone producing unit. However, in normal use one is not even aware particularly visually of the presence of the ozone producing unit simply because the dryer does not look anything different from a conventional dryer. As a further benefit, the corona grid which is a high charged unit, is located in a safe position well away from direct exposure to anyone using the dryer. Again, this is to be contrasted to dryer set ups where ozone producing units are provided in the door of the dryer to which the user is immediately exposed upon opening the dryer.

The dryer of the present invention, is for the reasons described above, able to provide bacteria fighting features due to the presence of an ozone producing unit. Furthermore, this is achieved at an extremely low cost factor relative to the overall cost of the dryer. Therefore, the dryer is not only effective but extremely marketable from a pricing standpoint.

Although various preferred embodiments of the invention have been described in detail, it will be appreciated that variations may be made without departing from the spirit of the invention or the scope of the appended claims.

The embodiments of the invention in which an exclusive property or privilege is claimed are defined as follows:

1. A domestic clothes dryer having a rearwardly exposed air intake providing a flow path for air to be circulated interiorly of said dryer, said air intake having an access region fitted with an ozone producing corona grid member positioned in said flow path so that the air is ozone charged prior to being circulated within said dryer, said corona grid member having a modular construction and being removably secured in said air intake for servicing thereof, said modular construction comprising a frame portion with an electrical grid secured in said frame portion, said electrical grid presenting a fixed position electrical contact extending out of said frame portion, said access region of said air intake comprising a door openable at said air intake, said door being provided with guide means for receiving said frame portion and said air intake including a contact closure positioned to receive said electrical contact of said electrical grid upon closing of said door with said frame portion fitted in said guide means.

2. A domestic clothes dryer as claimed in claim 1, wherein said guide means comprises a pair of guide tracks, said frame being slideable into said guide tracks.

3. A domestic clothes dryer as claimed in claim 1, wherein said door is hingedly secured to said air intake, said door when hinging closed with said frame portion fitted in said guide means moving said electrical contact to driver over an extended contact area against said contact closure of said air intake.

* * * * *